US008978333B2

(12) United States Patent
Potter et al.

(10) Patent No.: US 8,978,333 B2
(45) Date of Patent: Mar. 17, 2015

(54) STRUCTURE FORMED FROM PANELS JOINED WITH UNIVERSAL CLAMPING BRACKETS

(71) Applicants: Darrel V. Potter, Arlington, WA (US); Gary L. Potter, Monroe, WA (US)

(72) Inventors: Darrel V. Potter, Arlington, WA (US); Gary L. Potter, Monroe, WA (US)

( * ) Notice: Subject to any disclaimer, the term of this patent is extended or adjusted under 35 U.S.C. 154(b) by 0 days.

(21) Appl. No.: 13/969,501

(22) Filed: Aug. 16, 2013

(65) Prior Publication Data

US 2014/0157710 A1 Jun. 12, 2014

Related U.S. Application Data

(60) Provisional application No. 61/684,065, filed on Aug. 16, 2012.

(51) Int. Cl.

| | |
|---|---|
| ***E04B 2/00*** | (2006.01) |
| ***E04B 1/92*** | (2006.01) |
| ***E04C 2/04*** | (2006.01) |
| ***E04C 2/284*** | (2006.01) |

(52) U.S. Cl.

CPC . *E04B 1/92* (2013.01); *E04C 2/049* (2013.01); *E04C 2/284* (2013.01)

USPC ..... 52/582.1

(58) Field of Classification Search

USPC ..... 52/582.1, 309.1, 309.3, 393, 459, 474, 52/475.1

See application file for complete search history.

(56) References Cited

U.S. PATENT DOCUMENTS

| | | | | |
|---|---|---|---|---|
| 3,082,849 | A | 3/1963 | Keller | |
| 3,729,889 | A * | 5/1973 | Baruzzini | 52/264 |
| 4,075,811 | A | 2/1978 | Keith | |
| 5,056,290 | A | 10/1991 | Alexander et al. | |
| 5,709,056 | A * | 1/1998 | Matsuyama et al. | 52/235 |
| 6,301,851 | B1 * | 10/2001 | Matsubara | 52/430 |
| 7,665,264 | B1 * | 2/2010 | Wolfe | 52/586.2 |

OTHER PUBLICATIONS

Written Opinion dated Feb. 7, 2014, International Application No. PCT/US2013/055479, International Filing Date Aug. 16, 2013.

International Search Report dated Feb. 7, 2014, International Application No. PCT/US2013/055479, International Filing Date Aug. 16, 2013.

* cited by examiner

*Primary Examiner* — Mark Wendell
*Assistant Examiner* — Keith Minter
(74) *Attorney, Agent, or Firm* — Lane Powell PC

(57) ABSTRACT

A structure is constructed from a plurality of panels formed of Autoclaved Aerated Concrete (AAC), Structural Insulated Panels, plywood or the like. The shelter also includes bracket members that connect at least two panels together and clamp at least one panel to the bracket with clamping structures that activate when fasteners are secured to the bracket.

10 Claims, 10 Drawing Sheets

STRUCTURE FORMED FROM PANELS JOINED WITH UNIVERSAL CLAMPING BRACKETS

CROSS REFERENCE TO RELATED APPLICATIONS

This application claims priority to U.S. provisional patent application Ser. No. 61/684,065, filed on Aug. 16, 2012, the disclosure of which is hereby incorporated by reference.

FIELD

The present disclosure relates to shelters and, more particularly, to a shelter formed from modular components including universal brackets and planar members such as autoclaved aerated concrete panels, structural insulated panels, plywood and the like.

BACKGROUND

This section provides background information related to the present disclosure which is not necessarily prior art.

Autoclaved Aerated Concrete (AAC) panels are known to be lightweight, fire resistant, and sound insulative. These panes can also be very strong and can hear a significant amount of weight for use in the construction of various structures and shelters, such as homes, hotels, etc. Typically, a plurality of AAC panels are attached together to construct the structure. Similarly, Structural Insulated Panels ("SIP's") formed of a foam core that usually has an exterior and interior surface material applied thereto are also used to form floor, walls and roofs.

Although these structures have functioned adequately for their intended purposes, there are problems that remain. For instance, attaching the AAC and SIP panels can be difficult and time consuming. Also, the resulting joint between individual panels may not be sufficiently strong in certain uses and/or weather conditions. Specifically, conventional joints between AAC and SIP panels and other panels of material such as plywood and the like may not be able to withstand high winds, etc, occurring during severe weather conditions, such as hurricanes, typhoons, etc.

SUMMARY

This section provides a general summary of the disclosure, and is not a comprehensive disclosure of its full scope or all of its features.

A shelter is disclosed that is constructed from a plurality of AAC, or SIP panels or other panels such as plywood or the like. The shelter also includes brackets or joint members that connect at least two panels together. The brackets include a first flange that extends over and overlaps a first side of the at least two panels and a second flange that extends over and overlaps a second side of the at least two panels. At least one clamping element extends from the bracket into the panel and a fastener extends through bracket into the clamping element thereby clamping the clamping element toward a flange, thereby strongly joining the panels together.

Other features of the shelter include corner bracket assemblies that attach at least two panels disposed at an angle relative to each other. The corner bracket assembly can include a bracket with flanges operable to attach to at least one of the panels, a tubular retainer that is fixed to the bracket, and a threaded rod that is received in the retainer and that extends partially out of the bracket. The threaded rod can be attached to a foundation on one end, and the rod can compress a roof panel toward the foundation to thereby secure the shelter to the foundation.

The shelter can include one or more doors and windows. Also, the shelter can be modular such that the shelter can selectively include one or more rooms and floors. Also, the shelter can be configured into a pet shelter for sheltering a pet or other animal.

The shelter can include various features that allow the shelter to withstand high winds, precipitation, flying debris, and other hazards of a hurricane, typhoon, tornado, or other event. Thus, the shelter can protect occupants in a wide variety of conditions.

Further areas of applicability will become apparent from the description provided herein. The description and specific examples in this summery are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. FIGS. 1-10 disclose a preferred shelter 109 formed of modular panel 12 and bracket 14 components. Each of these embodiments is discussed in greater detail below.

Figure 1:
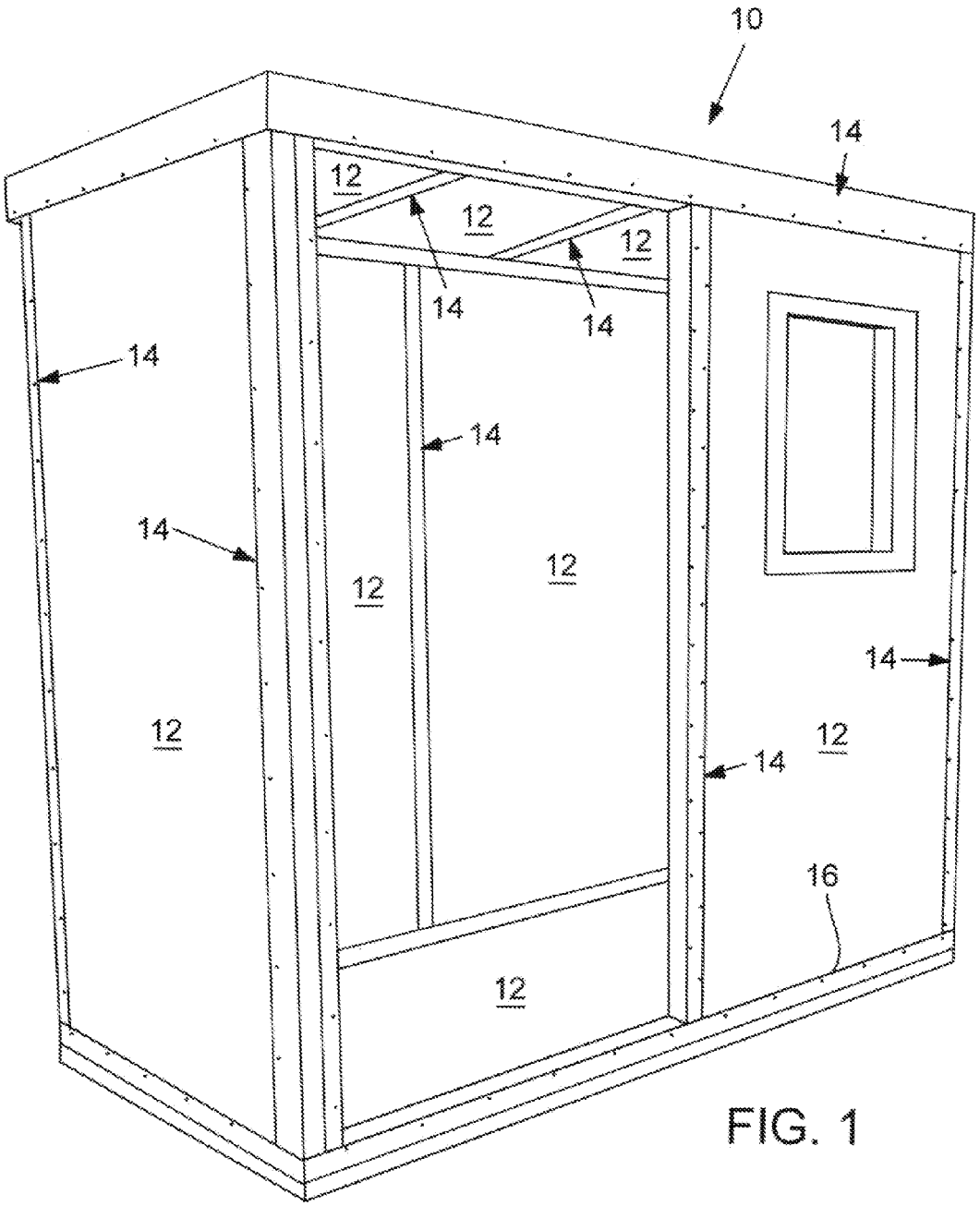
FIG. 1 is an isometric view shelter according to various teachings of the present disclosure.
Figure 2:
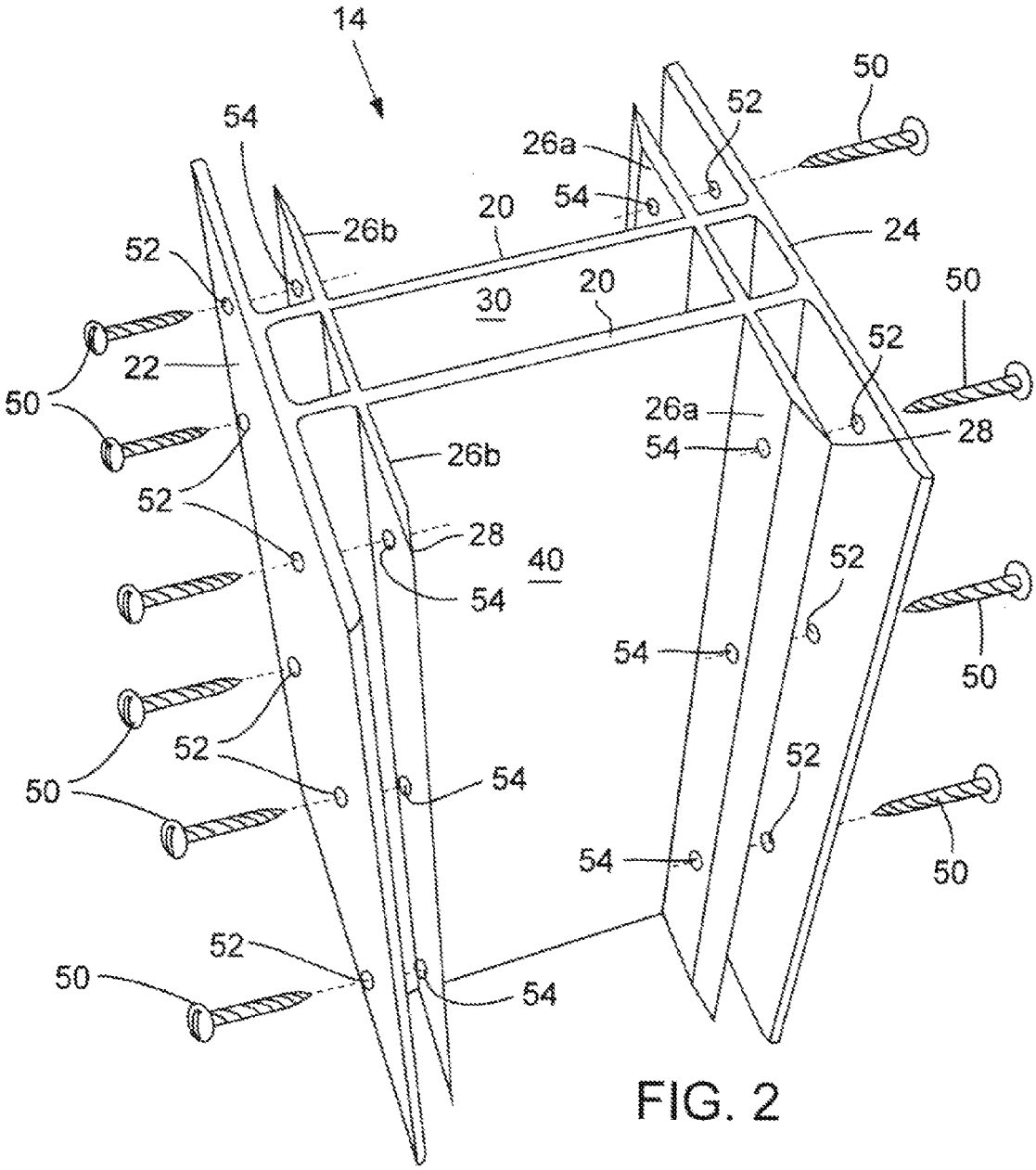
FIG. 2 is an isometric view of an exemplar bracket used to join two panels together to form the shelter of FIG. 1.

Referring initially to FIG. 1, a shelter 10 is illustrated according to venous exemplary embodiments. The shelter 10 can generally include a plurality of panels 12 that can be formed of suitable materials such as Autoclaved Aerated Concrete (AAC). Structural Insulated Panels ("SIP's"), plywood, or the like that are joined together edge-to-edge via a plurality of brackets 14 (i.e. joints or fleshing) and that are supported atop a foundation 16. As will be discussed, the shelter 10 can provide protection from the elements. Also, in some embodiments, the shelter 10 can withstand high winds, heavy precipitation, flying debris, and other effects of hurricanes, typhoons, tornadoes, or other extreme weather conditions.

As shown in FIG. 1 the panels 12 can be substantially flat panels that are elongate. As is known, the AAC panels 12 can be manufactured by combining ground silica sand, Portland cement, lime, water, and an expanding agent (e.g., ground aluminum powder), which is molded. During formation in a mold, the aluminum can react with the lime to produce hydrogen bubbles therein. The AAC panels 12 can be then cut into a desired shape from the bulk, molded material. The AAC panels 12 can be relatively lightweight and, yet, can bear significant loads. Also, the AAC panels 12 can be fire resistant and can be sound insulative.

Figure 3:
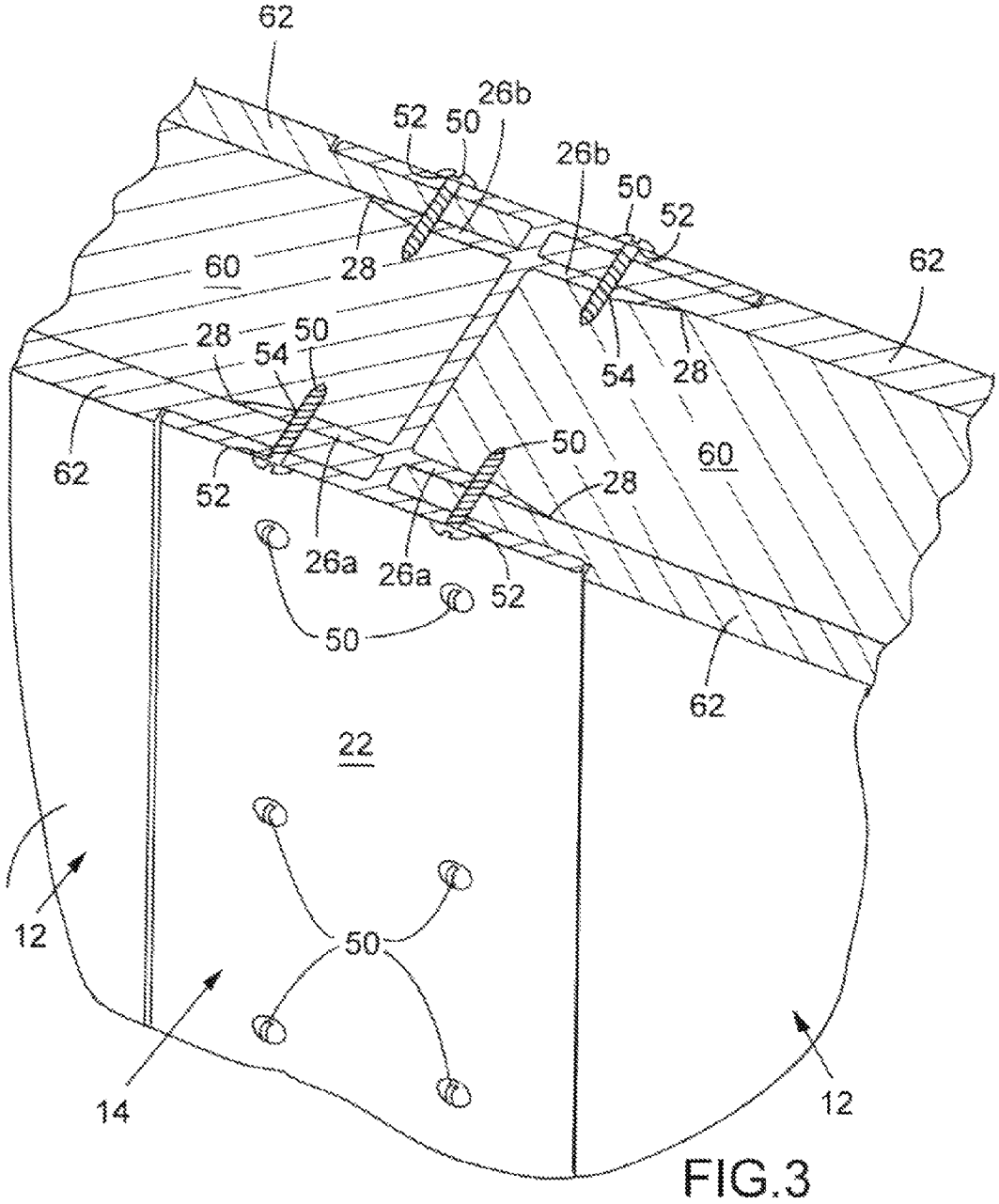
FIG. 3 is an enlarged isometric view of a bracket joining two panels together to form a planar wall in accordance with an embodiment of the present invention.
Figure 4:
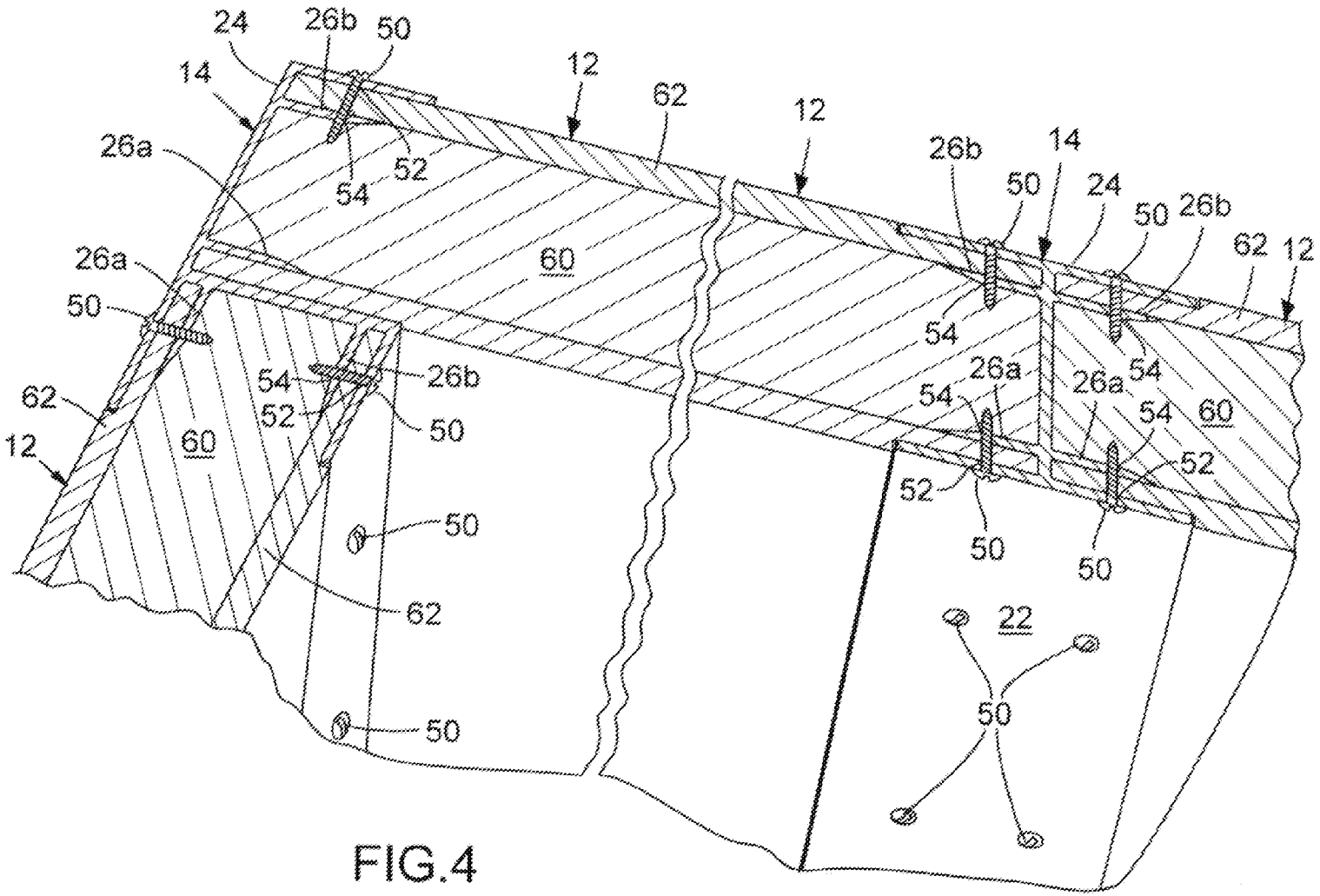
FIG. 4 is an enlarged, isometric view of a bracket joining two panels to form a corner of the shelter of FIG. 1 and a second bracket joining two panels together to form a planar wall of the shelter in accordance with an embodiment of the present invention.
Figure 5:
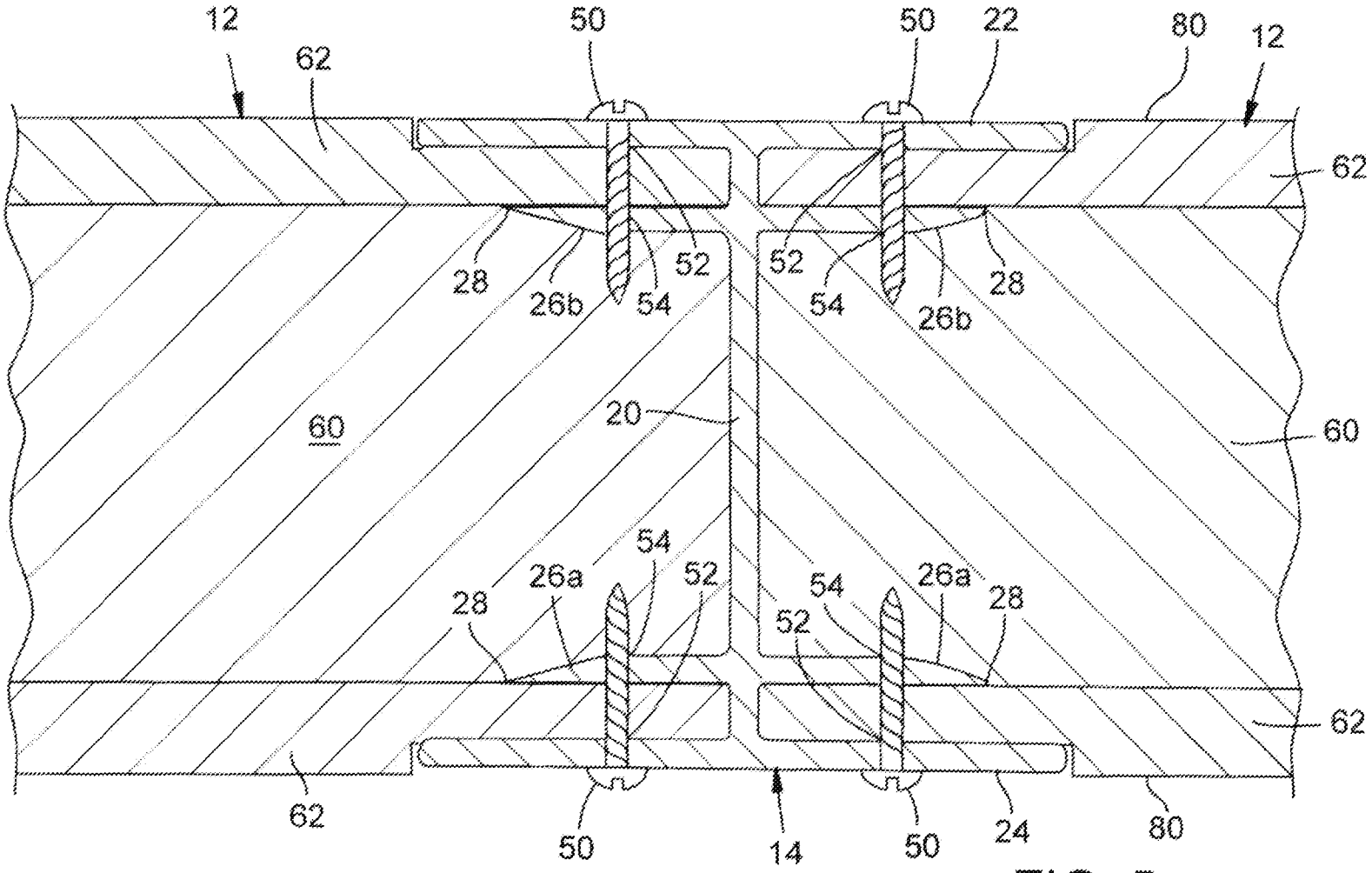
FIG. 5 is an enlarged cross sectional view of the bracket of FIG. 3.
Figure 6:
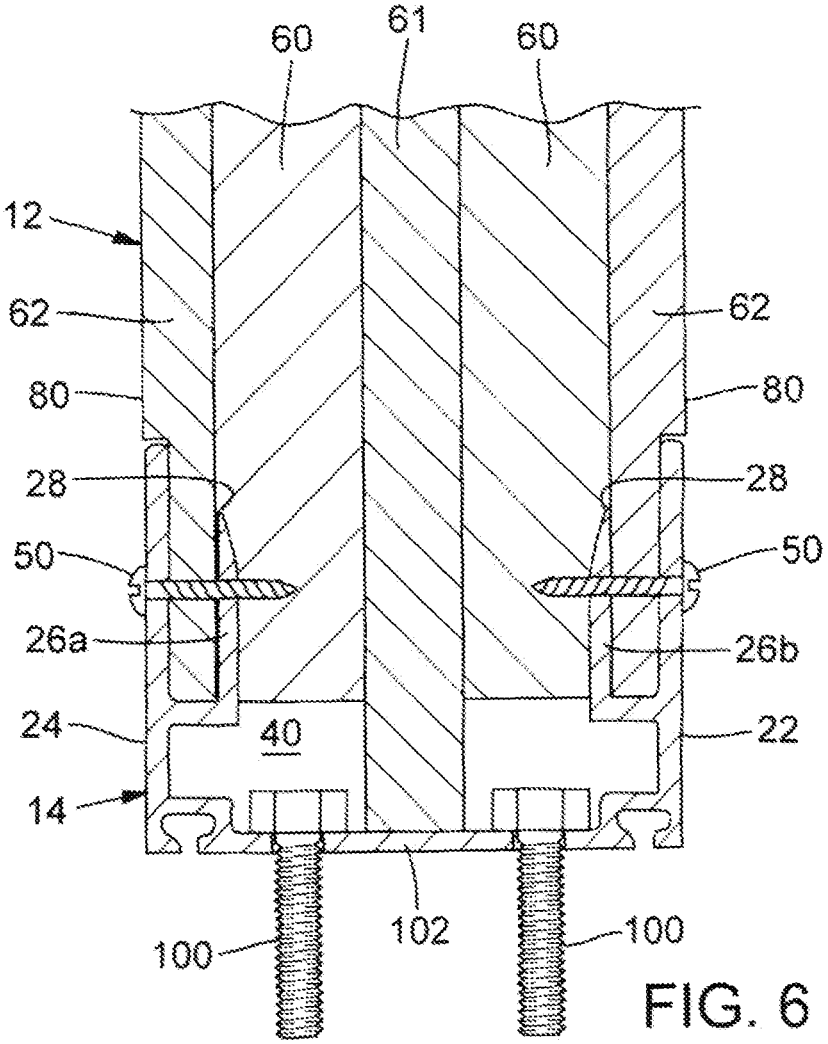
FIG. 6 is an enlarged ground mounting bracket showing possible mounting of a panel to the ground in accordance with an embodiment of the present invention.

Similarly, and as best shown in FIGS. 3-5, the panels 14 can be SIP's that are formed and constructed with conventional materials and methods. For example, the SIP can include a rigid polymer foam 60 sandwiched between two layers 62 of structural board, such as sheet metal, plywood, cement, oriented strand board. The polymer foam 60 can be expanded polystyrene foam (EPS), extruded polystyrene foam (XPS), polyisocyanurate foam, polyurethane foam or the like. An additional layer of other material 61 (FIG. 8), such as ballistic insulation, or the like may also be positioned within the SIP or operably secured to an exterior surface of the SIP as desired. In addition, an exterior surface material 210 (FIG. 10), such as plaster, stucco, paint or the like may be applied to the SIP as desired.

The shelter 10 can include any number of panels 12 of any suitable shape. Also, the shelter 10 can include one or more panels 12 that collectively define upright, vertical walls and other panels 12 that collectively define a roof. It will be appreciated that the shelter 10 could also include panels 12 made out a material other than those described herein in some embodiments of the present disclosure.

Moreover, the brackets 14 can nave a number of varieties. In some embodiments shown in FIGS. 2, 3, and 5, two panels 12 can be joined by a bracket to form an elongate planar structure such as a wall, roof, floor or the like. Alternatively, in some embodiments shown in FIGS. 4, 7, and 8, the brackets can be configured so as to join two panels 12 together to define a corner. The joint members 18, 20 can be made from bent sheet metal, such as steel and/or Aluminum, or they may be molded or extruded using conventional fabrication methods. On known material that works particularly well in this application is commonly known as Aluminum 6061.

The brackets 14 can each include a base 20 that wraps around a respective edge of the panels 12 and flanges 22, 24 extends perpendicularly away from the base 20 and capture the edge of the panel 14 therein as best shown in FIG. 5. Elongate protrusions 26*a*, 26*b* extend perpendicularly from the base and are parrallelly aligned and spaced apart from the flanges 22, 24. Fastener mounting holes are aligned to as to allow a fastener, such as a screw fastener to extend through a flange 22, 24 and be threadably received through holes 54 in the elongate protrusions 26*a*, 26*b* as best shown in FIG. 5. The faster extends through a portion of the panel, and mating recesses are preferably provided in the edge of the panel 14 so as to allow the protrusion to be received therein. Accordingly, can be appreciated that tightening the fastener draws the distal end 28 of the protrusion 26*a*, 26*b* toward its adjacent flange 24, 22, thereby allowing the protrusion to essentially clamp a portion of the panel 12 to the bracket 14. This clamping action allows the structure formed with these brackets to be quickly assembled while also being particularly strong and wind resistant.

Figure 7:
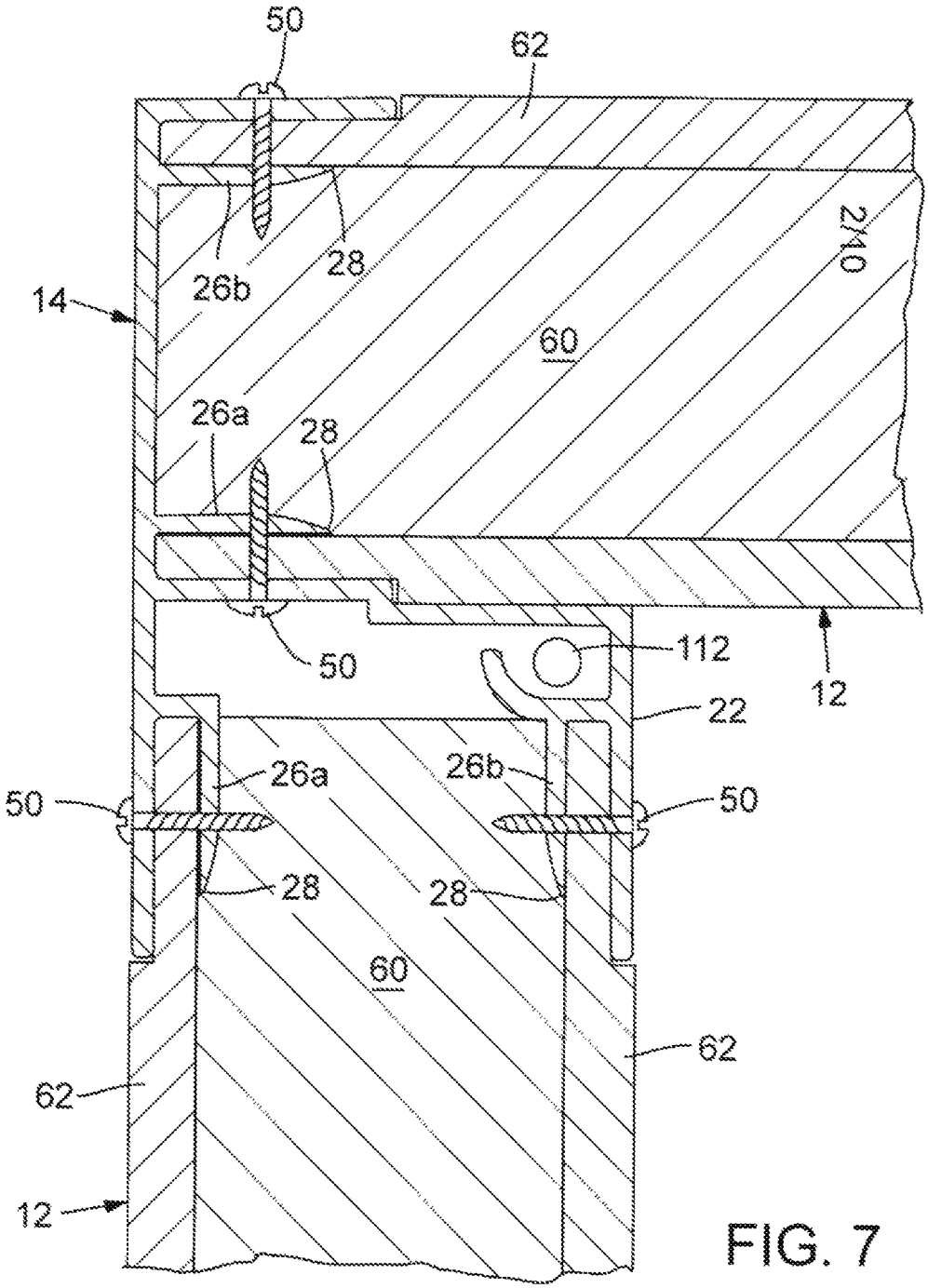
FIG. 7 is a cross-section of a corner mounting bracket in accordance with an embodiment of the present invention.
Figure 8:
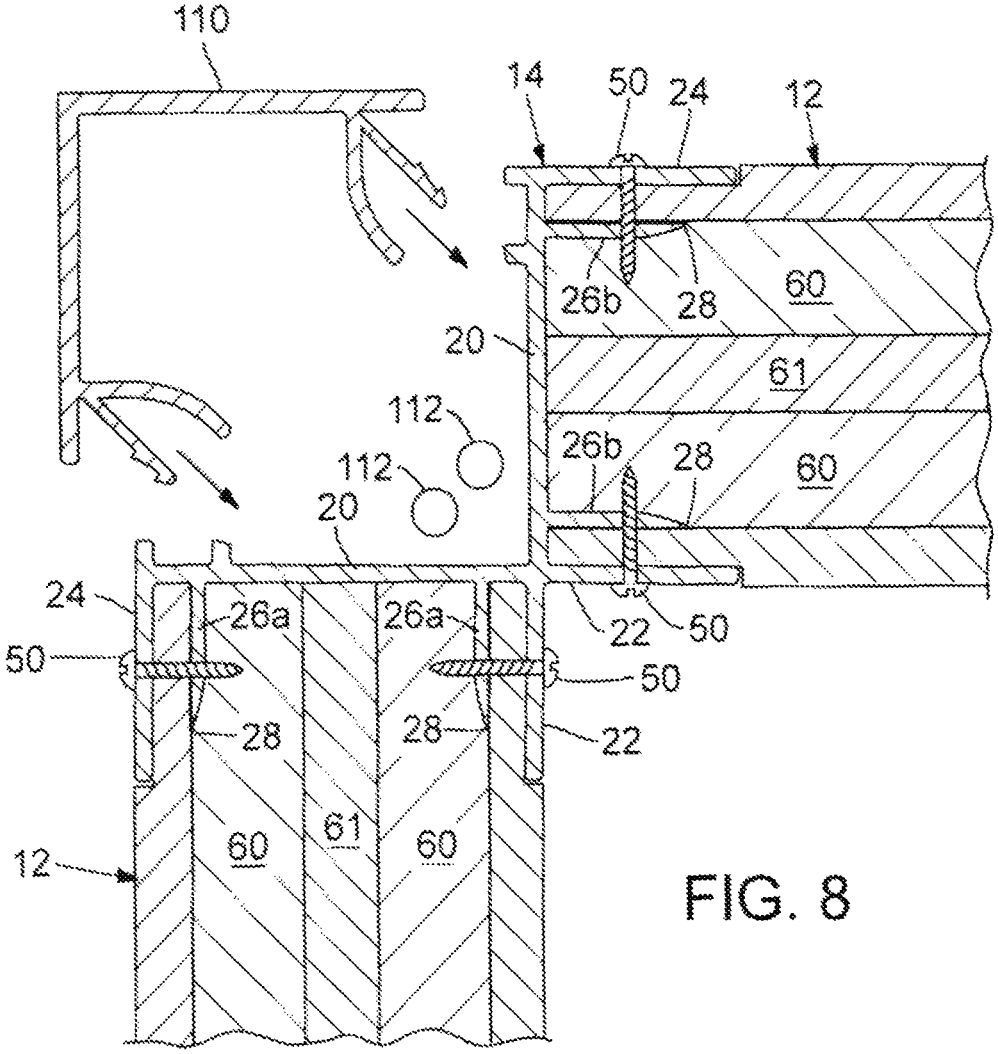
FIG. 8 is a cross-section of an alternative possible bracket in accordance with an embodiment of the present invention.
Figure 9:
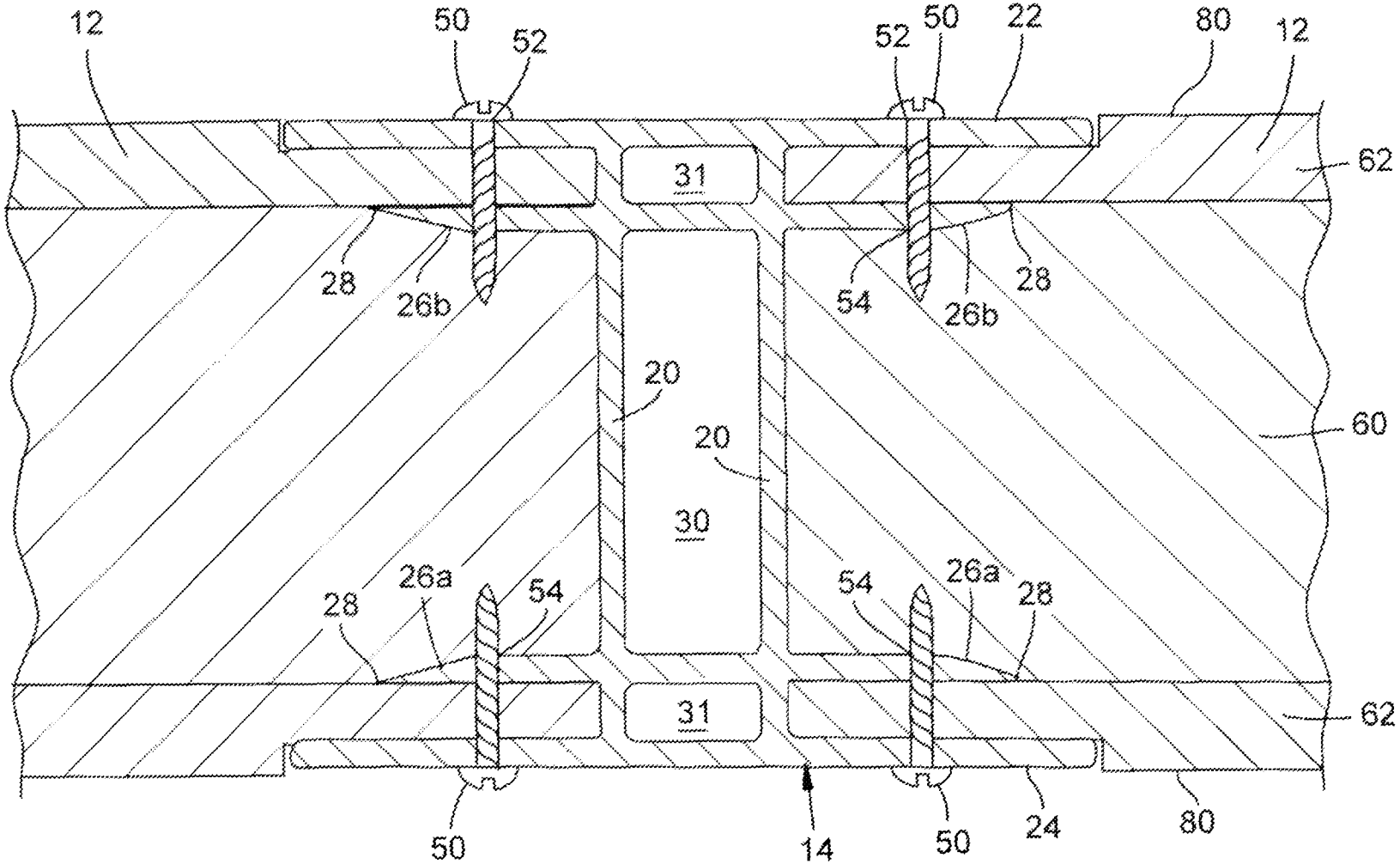
FIG. 9 is a cross-section of an alternative possible planar mounting bracket in accordance with an embodiment of the present invention.
Figure 10:
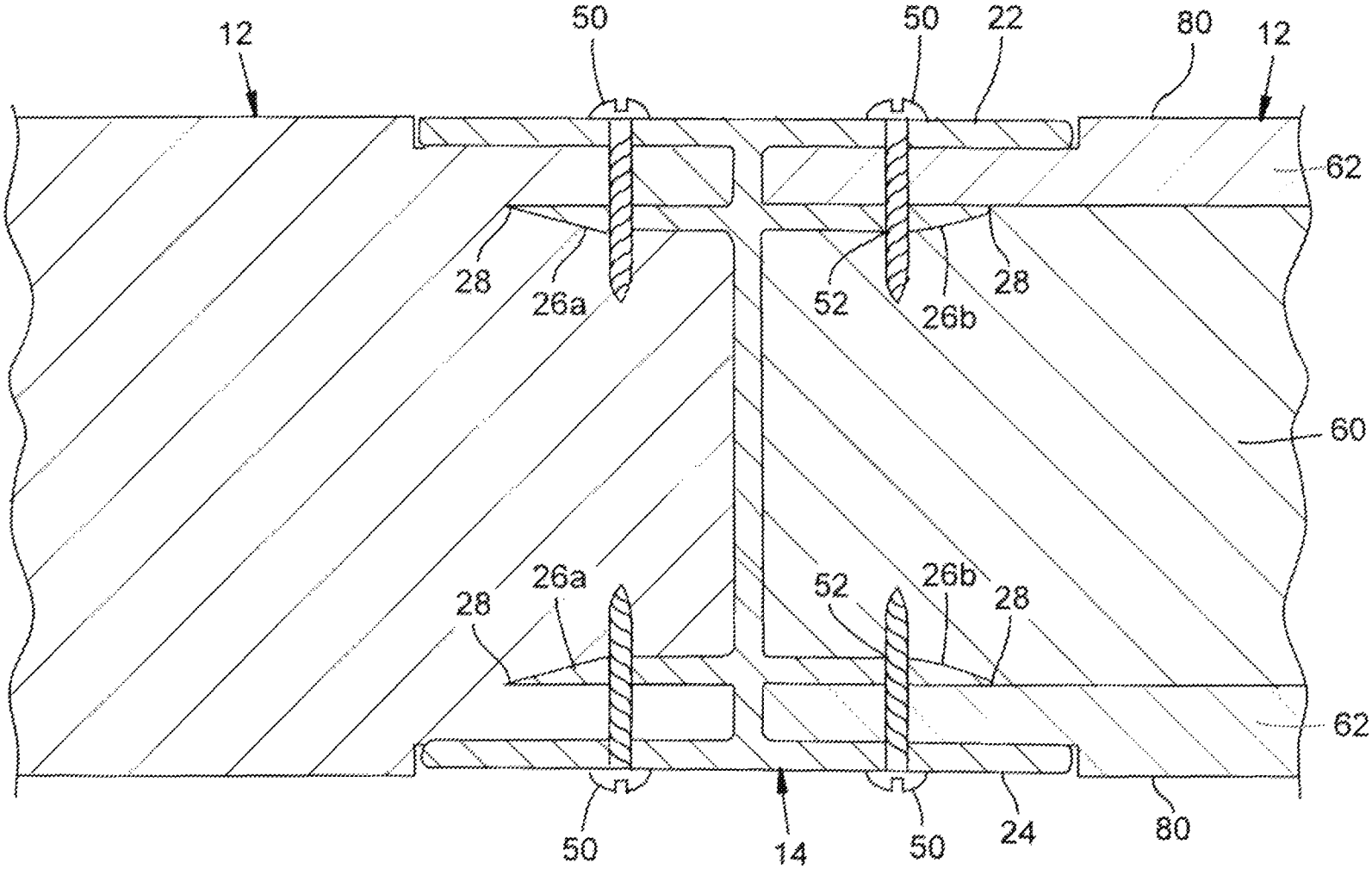
FIG. 10 is a cross-section of the planar mounting bracket of FIG. 3 sowing possible cross-sections of panels mounted thereto.

Referring to FIGS. 7 & 8, the brackets 14 also include a corner joint assembly that connects at least two panels 12 at an angle (e.g., ninety degrees). The bracket 14 can include a hollow for receiving cables 112 or the like therein. The cables can include steel securing cables that around mounted to the ground for holding the structure in place during high winds or the like. In addition other items, such as electrical wiring and the like can be extended through the hollow as needed.

A layout of a one-room shelter 10 is illustrated in FIG. 1. In some embodiments, the shelter 10 can be approximately 7'4" by 7'4". This layout can be sized to be useful as a home, a shed, a medical care facility, a latrine (i.e., housing a toilet, sink, etc.), a school or for other uses. In other embodiments, the size of the shelter 10 can be reduced to house and protect a pet or other animal (e.g., a doghouse). The components of the present invention may be combined as needed to build multiple story structures.

Moreover, the panels 12 can be arranged to include windows and doors (hinged or sliding doors) with frames made out of metal or other materials.

Also, a coating, such as Stucco, can be applied on the outer surfaces of the panels 12 for aesthetic purposes and to further protect the shelter 10 against the elements. Moreover, the shelter 10 can include an interior flooring The flooring can be wooden planks that are arranged edge-to-edge, a cement slab, etc. The flooring can be an exposed portion of the foundation 16 in some embodiments, or the flooring can be separate and can overlay the foundation 16. The flooring can also include a mat, such as a rubber mat that is laid over the foundation 16.

The shelter 10 can also include certain modular features. For instance, the shelter 10 can be configured to include optional rooms, wings, or other features. For instance, the brackets 14 can be configured to join a plurality of panels 12 into a variety of optional rooms or wings. It will be appreciated that a set of panels 12 and joints 14 can be included in a kit, and the user can earl decide whether to assemble the panels 12 and joints 14 of the kit into a one-room or multiple room shelter 10. In some embodiments, a number of different floor plans can be built from the same amount of panels 12 and joints 14. Also, in some embodiments, the user can attach additional rooms or wings to an already-standing shelter 10. Furthermore, in some embodiments, multiple individual one-room shelters 10 can be connected for increased modularity.

The materials for the sheet 10 (i.e., panels 12, joints 14, fasteners etc.) can be transported in a disassembled state on one or more standard pallets. Also, in some embodiments, a plurality (e.g. twenty) of sets of materials (e.g., enough for twenty shelters 10) can be palletized and fit inside a standard 20' shipping container. Thus, the materials can be transported across large distances, for instance, to areas of the word that experience typhoons, hurricanes, or other extreme weather events. Because the materials of the shelter 10 are highly portable, many shelters 10 can be provided in a relatively short amount of time to people that are at risk from these weather events.

Accordingly, the shelter 10 can provide protection against harsh winds (e.g., up to 185 mph winds), heavy precipitation, flying debris, etc. Also the shelters 10 can be quickly and easily assembled and disassembled. Moreover, the shelters 10 can be modular and adaptable according to the needs of the users. Furthermore, the materials for the shelters 10 can be palletized and relatively easily transported to almost any place in the world.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A structure comprising:

a first substantially planar panel;

a second substantially planar panel;

a bracket operably securing said first substantially planar panel to said second substantially planar panel, said bracket having a base that operably engages an edge of one of the first and second panels;

a flange extending substantially perpendicular from the base;

an elongate protrusion aligned substantially parallel with the flange and spaced apart from the flange by a defined distance, the elongate protrusion extending into the planar panel; and, a fastener extending through the flange, a portion of the panel and the elongate protrusion such that tightening of the fastener draws a distal end of the fastener toward the flange thereby clamping the portion of the panel to the bracket.

2. The structure of claim 1, where said structure is a shelter.

3. The structure of claim 2, further including a window operably secured to at least one of the first and second panels.

4. The structure of claim 2, further including a roof operably secured to the structure.

5. The structure of claim 1, further including a second flange and a second elongate protrusion, said second elongate protrusion aligned substantially parallel with the second flange and spaced apart from the second flange by a defined distance, the second elongate protrusion extending in the planer panel; and a second fastener extending through the second flange, a second portion of the panel and the second elongate protrusion such that tightening the second fastener draws a distal end of the second elongate fastener to the second flange thereby clamping the second portion of the panel to the bracket.

6. The structure of claim 1, wherein said fastener is a screw fastener.

7. The structure of claim 1, wherein said elongate protrusion has a tapered end defining a sharp point at the distal end.

8. The structure of claim 7, wherein said elongate protrusion defines a knife.

9. The structure of claim 1, wherein said first panel and said second panel is selected from the group consisting of Autoclaved Aerated Concrete, Structural Insulated Panels, and plywood.

10. The structure of claim 9, further including a layer of ballistic insulation operably secured to at least one of the first and second panels.

* * * * *